United States Patent [19]

Arana Ibarra

[11] Patent Number: 4,721,026

[45] Date of Patent: Jan. 26, 1988

[54] MORTAR

[75] Inventor: Iñigo Arana Ibarra, Vizcaya, Spain

[73] Assignee: Esperanza y Cia, S.A., Spain

[21] Appl. No.: 849,752

[22] Filed: Apr. 9, 1986

[30] Foreign Application Priority Data

Mar. 17, 1986 [ES] Spain ..... 292.982[U]
Mar. 17, 1986 [ES] Spain ..... 292.984[U]
Mar. 26, 1986 [ES] Spain ..... 553.428

[51] Int. Cl.[4] ..... F41F 1/06; F41G 5/00
[52] U.S. Cl. ..... 89/37.05; 89/37.09
[58] Field of Search ..... 89/1.3, 1.35, 37.05, 89/37.09, 40.02

[56] References Cited

U.S. PATENT DOCUMENTS 2,197,816 4/1940 Tate ..... 89/40.02

FOREIGN PATENT DOCUMENTS 75634 4/1983 European Pat. Off. ..... 89/37.05
792740 1/1936 France ..... 89/1.3
572198 1/1976 Switzerland ..... 89/37.05

*Primary Examiner*—Stephen C. Bentley
*Attorney, Agent, or Firm*—Lucas & Just

[57] ABSTRACT

A mortar having a barrel pivotally mounted on a platform and having a tripod and a rear set of legs is disclosed. The tripod has three parallel legs, the center one of which houses a spindle for changing the elevation of the barrel. Both the tripod and the rear set of legs are pivotally mounted on the platform. The arrangement of the tripod and rear legs are such that they minimize the number of obstructions normally associated with a mortar.

11 Claims, 8 Drawing Figures

MORTAR

Conventional weapons of war have not been subjected over recent years to improvements as it might have been necessary to introduce into their use, this being chiefly due to investment efforts having been channelled towards more sophisticated weapons such as those embodying electronics or nuclear power.

This omission means that the risks, inconvenience during handling, their excessive weight, the lack of accessories and ancilliary mechanisms and so on are all practically the same as after the Second World War, and this is especially so if such a conventional weapon as a mortar is considered.

By way of an example, it may be noted that in practice, the use of mortars either for training, tactical exercises or in warfare, involves such swiftness in handling the weapons that the very users themselves find that they become obstructed by or accidentally hitched onto any protrusion from the actual mortar with the undesirable results that this may bring.

The laying of a mortar in its firing position requires that its elevation and aiming mechanisms are previously adjusted to the required settings, where this normally entails the use of handwheels whose stub shafts positively protrude from the equipment and are therefore liable to cause accidents for the above mentioned reason.

The mortar covered by this invention is a mortar which is practically devoid of protrusions, capable of being simply positioned upon the platform belonging to its means of transport, easy to handle and of exceeding simplicity in its ancilliary mechanisms.

FIG. 1 depicts a general elevational view of the mortar covered by this invention and shows all the chief components that make it up.

In this figure, the position of the barrel (10) at maximum elevation is shown by lines in dots and dashes.

This figure also shows a partial section of the anchoring area with spacial links between the barrel (10) and the base platform (20).

The tripod unit (30) and set of rear legs (40) comprise the means for raising or lowering the barrel in a tipping motion on a vertical plane with respect to the base platform (20) in conjunction with spindle (50).

Figure 1:
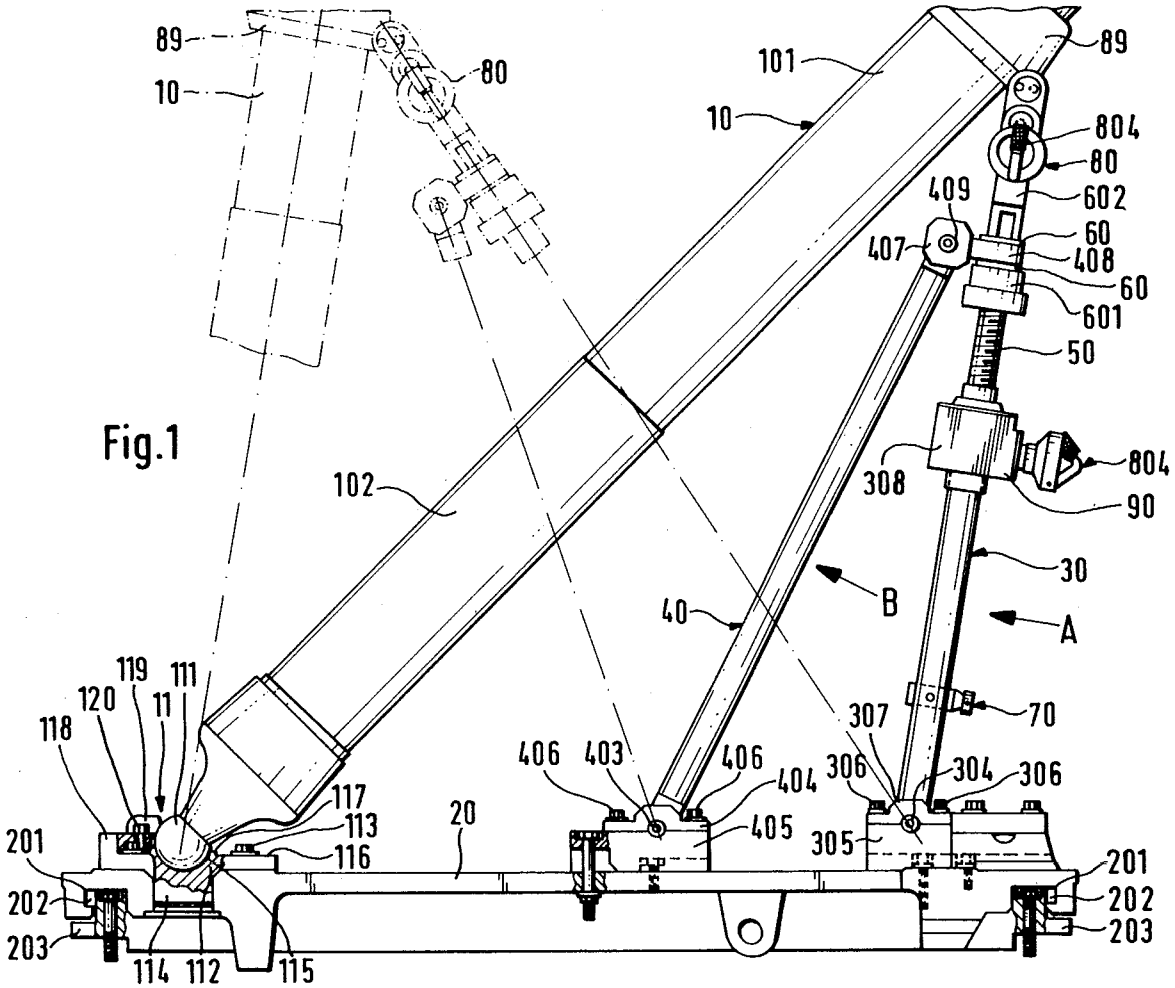
Figure 2:
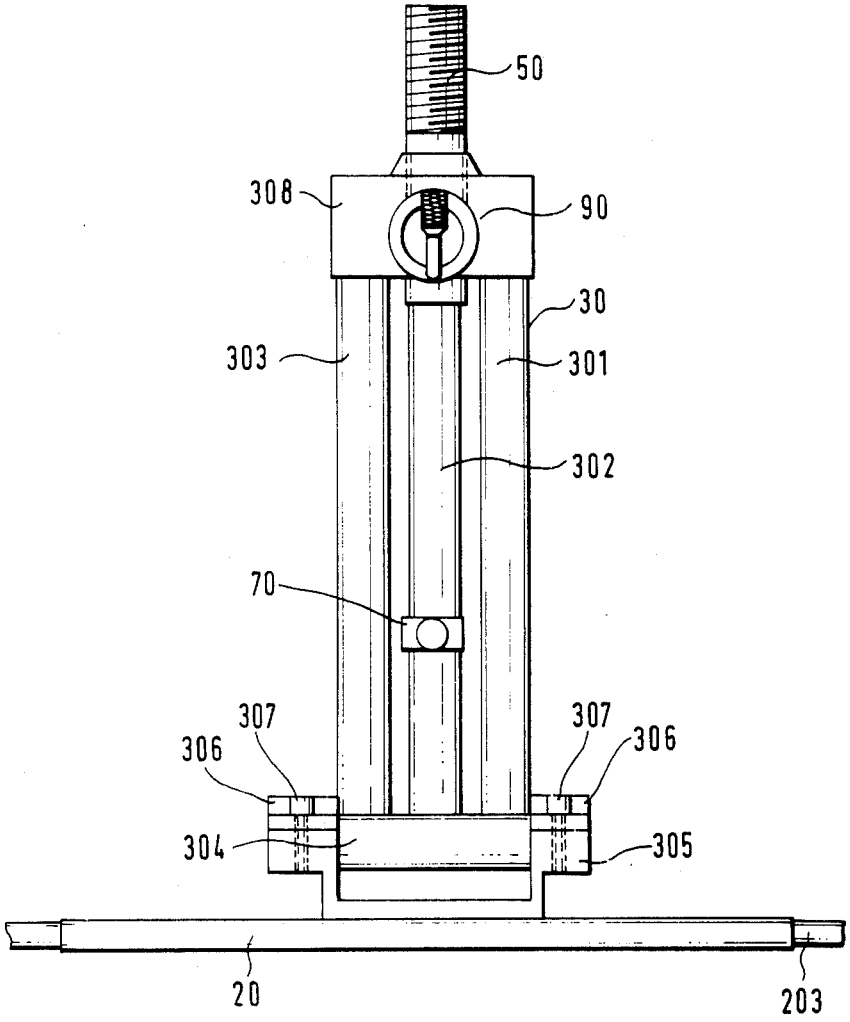
FIG. 2 is a partial front view of the parallel legged (30) tripod in the direction of "A" in FIG. 1.
Figure 3:
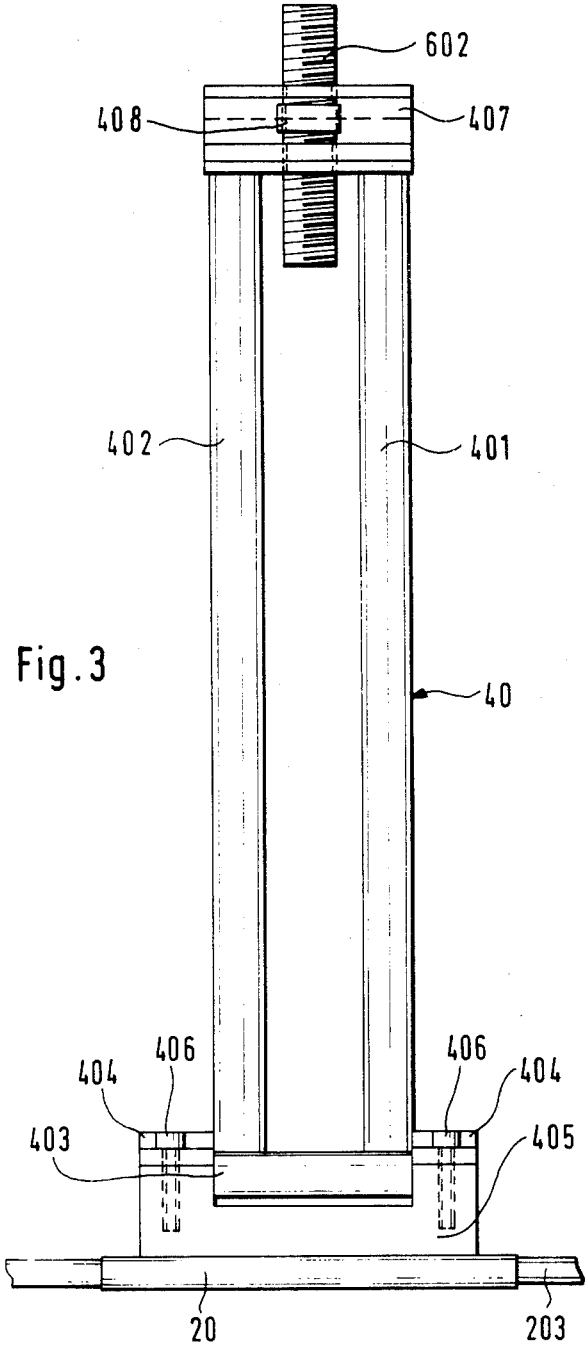
FIG. 3 is a partial front view of the set of two rear legs (40) in the direction of "B" in FIG. 1.
Figure 4:
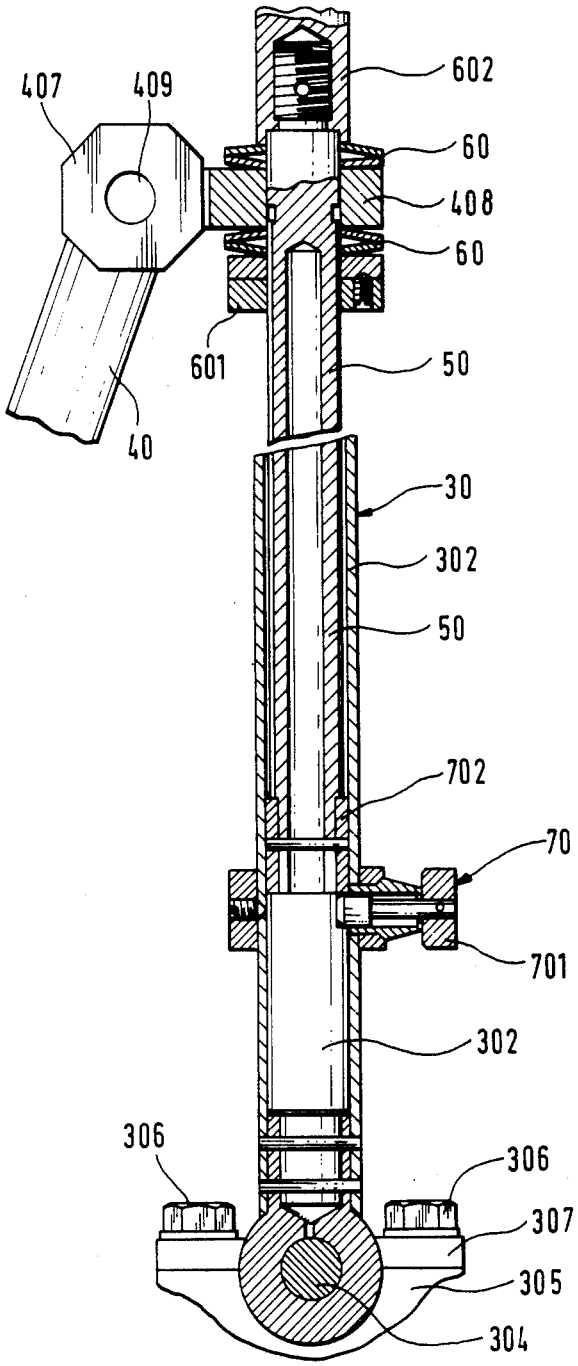

FIG. 4 depicts a sectionned elevational view of the center leg (302) on the parallel legged (30) tripod, and spindle (50) with its anchoring mechanism (60) between the set of parallel legs (40) and the spindle (50), the stop device (70) located on the center leg (302) of the tripod (30), and the way the tripod (30) is pivoted onto the base platform (20).

Figure 5:
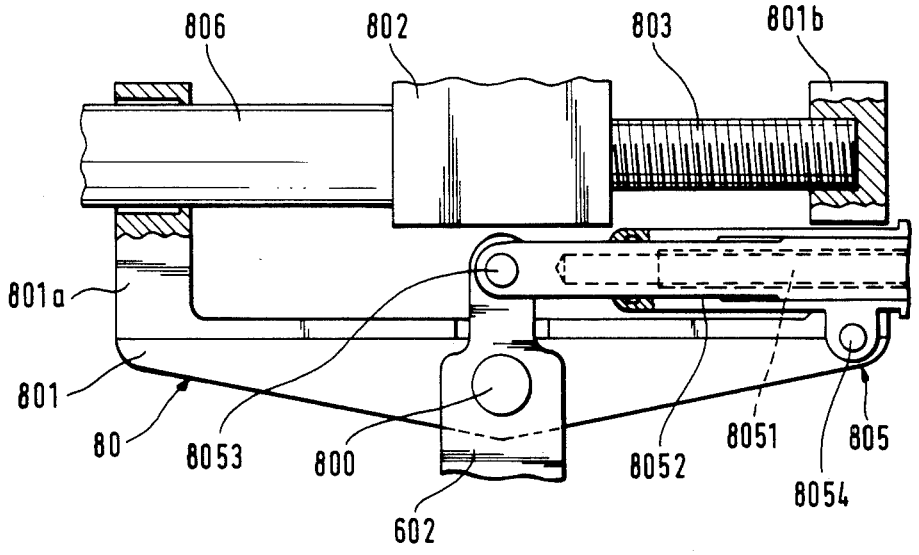

FIG. 5 depicts a diagrammatic front view of the sweep adjustment mechanism (80) for setting the barrel in the transverse plane.

Figure 6:
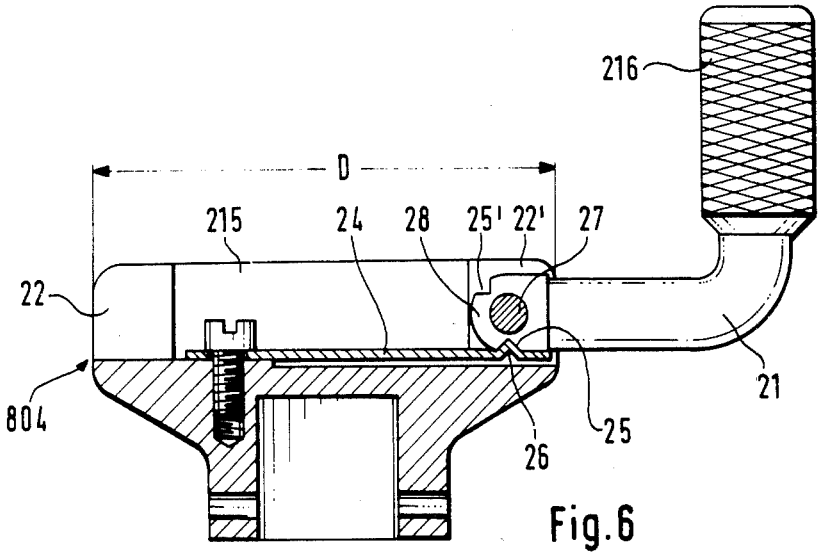

FIG. 6 is a sectional view of handwheel (804) belonging to the mortar, with its handle (21) unfolded.

Figure 7:
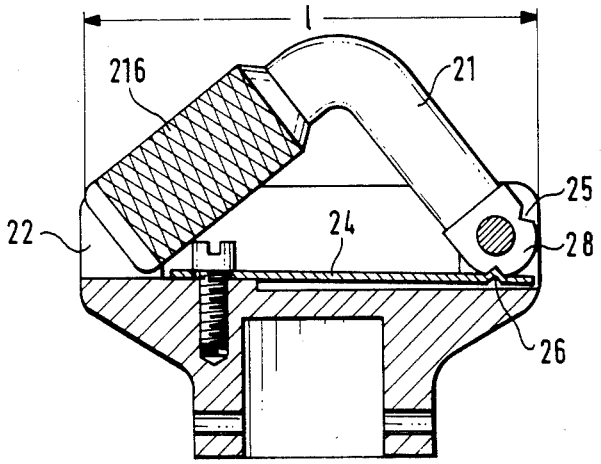

FIG. 7 shows the handwheel depicted in FIG. 6 with its handle (21) folded away.

Figure 8:
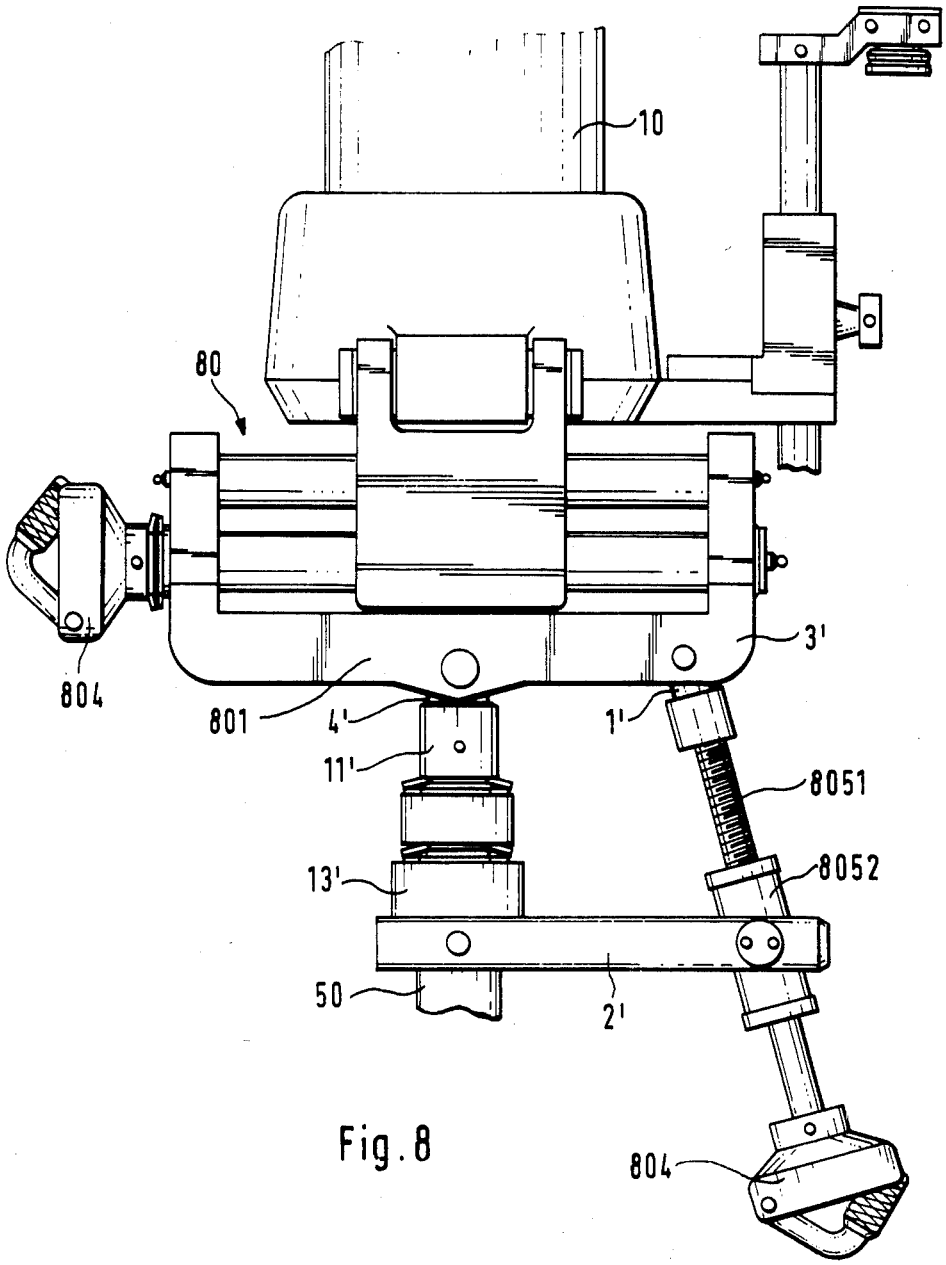

FIG. 8 shows an alternative arrangement for the mechanism in FIG. 5.

Said mechanism (80) is assembled pivotally on the top of spindle (50) and is slidingly linked to the barrel (10) by means of a collar (89).

The mortar, as specified herein, is essentially comprised of:

a barrel (10);

a base platform (20);

means of pivoting (11) between said barrel (10) and said base platform (20);

means for tipping (30), (40),(50) to raise and lower the barrel (10) in the vertical plane;

a mechanism (80) for adjusting the sweep in order to set the barrel (10) as required in the transverse plane.

The barrel (10) possesses at least two areas (101) (102) of differing sections, where that having the greater section is the one required to withstand higher stresses while the weapon is in use.

Means for spacial pivotal positioning (11) are provided at the support area between the barrel (10) and the base platform (20).

Said means (11) comprise:

a head (111), with spherical cap, on the end of the barrel (10);

a flange (112) assembled upon said base platform (20) by means, for example, of screws (113) and a guide shaft (114).

Flange (112) possesses a slot (115) in which the head (111) is accommodated, and three flat areas (116), (117),(118), of which the two outer ones (116), (118) are parallel to each other, while the middle one (117) which slopes, carries the slot (115) and links the other two.

Head (111) is assembled inside slot (115) with the ability to pivot spacially, and to prevent it from coming out of its location, a flange (119) is provided at area (118) which also holds the head (111), and said flange is secured, for instance, by means of screws (120).

The base platform (20) may, in turn, revolve up to 360 degrees in a horizontal plane. To this end, it defines guides (201) in which are housed some rails (202) arranged upon a supporting structure (203), which itself may perfectly well be that belonging to a vehicle, in which case the mortar as a whole becomes transportable.

The means for tipping the barrel (10) in relation to the base platform (20) in a vertical plane are:

a tripod with parallel legs (30);

a set of two legs (40);

a spindle (50), operated by:

lifting means (90).

The tripod (30) is comprised of three parallel legs (301),(302), (303) which are pivoted about a common axis (304) to the base platform (20).

Such connection to the base platform (20) is accomplished by the insertion of a "U" shaped member (305) whose arms each extend in a strut towards the outside, and is attached, by means of welding for instance, to said base platform (20). Said "U" member (305) holds shaft (304) upon which are pivoted legs (301),(302) (303). Shaft (304) and member (305) are each fixed and able to pivot about one of two identical flanges (306) which are bolted (307) to said "U" shaped member (305).

At their tops, legs (301) (302), (303) are stiffened by means of part (308) in which is housed the raising mechanism (90) for spindle (50).

Center spindle (50) travels coaxially within the center leg (302) of the tripod (30), (which, for such purpose, is hollow) upon being driven by the raising mechanism (90).

Such coaxial travel is limited by a lower stop (70) which, while limiting the travel of spindle (50), limits also the tipping range of the barrel (10) and thus defines a minimum elevation position.

Said lower stop (70) is essentially comprised of a positioner (701) which is fixed to leg (302) and holds an inside sleeve (702) against which spindle (50) abuts and thus limits the travel range in one direction.

The set of legs (40) is made up of two parallel legs (401), (402) that are pivotally attached upon a common shaft (403) to the base platform (20).

Such attachment to the base platform (20) is accomplished by the insertion of a "U" shaped member (405) which is attached, by welding for instance, to said base platform (20). Said "U" member (405) holds shaft (403) upon which are pivoted legs (401), (402). Shaft (403) and member (405) are each fixed and able to pivot about one of two identical flanges (404) which are bolted (406) to said "U" shaped member.

At their tops, legs (401), (402) are pivotally attached upon a shaft (409) to a member (407) which in turn defines a sleeve (408) in which is fitted spindle head (50). The assembly of said spindle head (50) inside sleeve (408) is accomplished by means of two sets of pressure rings (60) of which one is located at either side of said sleeve (408) and secured there by its respective positioning piece (601) or (602).

Piece (602) is that which connects the assembly to the sweep adjustment mechanism (80) described hereunder.

The essential purpose of said mechanism (80) is to control the transverse or sweeping motion of the barrel (10).

In accordance with one particular preferred mode of construction, said mechanism (80) is structured from:

a support fork (801) pivotally attached at (800) to sleeve (602) and, accordingly, to the spindle head (50) which is rigidly attached to said sleeve (602).

a control fork (802) pivotally attached to guide collar (89) which travels upon the barrel (10);

a universal spindle (803) assembled upon arms (801*a*), (801*b*) of said support fork (801), and provided with an arrangement (804) of its own which drives it rotatingly so as to cause displacement of fork (802) upon which fork (803) is screw threaded;

a levelling mechanism (805) possessing its own drive arrangement (not shown) which may be similar to arrangement (804) or different therefrom.

In the construction illustrated in FIG. 5, said levelling mechanism (805) is comprised of:

a spindle (8051) whose head is pivotally attached at (8053) to the main spindle (50) at a point above the pivotal attachment (800) between spindle (50) and the support fork (801);

a sleeve (8052) which is pivotally attached at (8054) to the support fork (801), and in whose inside spindle (8051) is able to travel slidingly.

With this structure, any travel undergone by spindle (8051) with respect to sleeve (8052) will cause fork (801) to tip in order to achieve the levelling of the sweep control mechanism.

The sweep control mechanism is completed with a guide (806) fitted onto fork (801) within which the control fork (802) travels upon being displaced by spindle (803).

In FIG. 5 said guide (806) is arranged coaxially to the spindle (803).

FIG. 8 provides a front view of a levelling mechanism linked to the sweep mechanism by way of an alternative to the mechanism illustrated in FIG. 5.

The mortar (10) sweep mechanism (80) comprises a flange (801) upon whose center is pivotally attached the head (4') of raising spindle (50) or the prolongation of a sleeve (11') fixed onto said raising spindle (50).

A second sleeve (13') on spindle (50) carries a strip (2') to the end of which is pivotally attached a third sleeve (8052) which acts as the support for a levelling spindle (8051).

Handwheel (804) enables said levelling spindle (8051) to be rotated, where same is pivotally attached at its head (1') to one end of flange (3').

The control of the various motions and mechanisms of the mortar is accomplished with handwheels such as that illustrated in FIGS. 6 and 7, and which possess a handle (804) whose rim is knurled or ridged to facilitate manual operation without any need to use the handle (21).

Rim (804) is approximately cylindrical in shape and has an inside hollow (215) and two diametrically opposed openings (22), (22').

In the bottom of hollow (215), there is attached a flexible metal strip (24) or other flexible means whose free end is extended through one of the openings (22') in the rim (804).

In its working position, handle (21) protrudes from the rim (804) and is able to revolve about axis (27) located in the first opening (22') in the rim (804).

In the carrying or idle position, that is to say, when there is no need for the mortar mechanisms to be operated, the handle is folded (See FIG. 7), and its head (216) is concealed in the second opening (22), and for this reason, its length (1) should be similar to the diameter (D) of the rim.

The shaft (28) for rotation of the handle (21) possesses two grooves (25), (25') which engage with a protrusion (26) on the strip (24) so that handle (21) is held in the working poaition (see FIG. 6) when the first groove (25) is in engagement with the protrusion (27), and in the idle position (see FIG. 7) when the second groove (25') is in engagement with protrusion. (26).

I claim:

1. A mortar, characterized because it is comprised of a barrel mounted upon a base platform with:

(a) means of spacial pivotal linking between said barrel and said base platform;

(b) means for tipping the barrel in a vertical plane which comprises:

($b_1$) a tripod with parallel legs that are pivotally attached to said base platform, and fitted with a raising mechanism, said parallel legs extending from and being parallel from said base platform to said raising mechanism;

($b_2$) a lower stop, located upon one of the tripod legs, to act as a minimum elevation angle limiter to operate in conjunction with:

($b_3$) a main spindle which is driven by the raising mechanism and makes the barrel tip, where said spindle is connected to said barrel through the cross control mechanism which travels in relation thereto thanks to a guide collar;

($b_4$) a set of rear legs which are parallel and likewise pivotally attached to said base platform, and mounted upon the spindle each with a set of pressure rings, said rear legs extending from and being parallel from said base platform to said spindle;

(c) a mechanism for sweep control for crosswise adjustment of the barrel.

2. A mortar in full accordance with claim 1 and characterized by the fact that the means for pivoting the barrel upon the base platform comprise:

(a) a spherical shaped head arranged at that end of the barrel which rests;

(b) a flange mounted upon said base platform and whose top defines two outside parallel faces between which lies a center sloping face provided with a hollow in which is housed the spherical head arranged on the end of the barrel;

(c) a sealing strip positioned on the raised bottom of said flange and surrounding the spherical head lodged inside the hollow so as to enable it to revolve spacially without disassembly.

3. A mortar in full accordance with the first claim and characterized because the sweep control mechanism is structured from:

(a) a support fork that is pivotally attached to the head of the spindle;

(b) a control spindle that is pivotally attached to the guide collar which travels on the barrel;

(c) a cross spindle mounted upon the arms of said support fork and possessing its own drive arrangement which, upon rotating, moves the control fork in a crosswise direction, and with it, the collar and barrel;

(d) a levelling mechanism.

4. A mortar, in full accordance with claim 3, and characterized because said levelling mechanism is comprised of:

(a) a spindle whose head pivots upon a flange in the sweep mechanism, and which slides within:

(b) a sleeve which pivots upon:

(c) a strip that is attached to a sleeve on the raising spindle upon which the support fork is pivoted.

5. A mortar in full accordance with claim 1 and characterized because the barrel possesses a different section in at least two of its areas, where the area(s) of greatest section is/are that/those which must withstand the highest stresses whilst the weapon is in use.

6. A mortar, comprised of a barrel mounted upon a base platform and further comprising:

(a) means of spatial pivotal linking between said barrel and said base platform;

(b) means for tipping the barrel in a vertical plane which comprises:

(1) a tripod with parallel legs that are pivotally attached to said base platform, and fitted with a raising mechanism;

(2) a lower stop, located upon one of the tripod legs, to act as a minimum elevation angle limiter to operate in conjunction with:

(3) a main spindle which is driven by the raising mechanism and makes the barrel tip, where said spindle is connected to said barrel through a cross control mechanism which travels in relation thereto thanks to a guide collar;

(4) a set of rear legs which are parallel and likewise pivotally attached to said base platform, and mounted upon the spindle, each with a set of pressure rings;

(5) the lower stop fitted onto one of the tripod parallel legs within which the spindle travels coaxially, said lower stop comprised of:

(i) a stop sleeve located inside the leg portion and positionable by:

(ii) a stop ring assembled upon the outside of said leg portion in such a manner that during the travel of said spindle when driven by said means for tipping, said spindle abuts the inside sleeve and thus defines the minimum elevation position; and (iii) a mechanism for sweep control for crosswise adjustment of the barrel.

7. A mortar, comprised of a barrel mounted upon a base platform and further comprising:

(a) means of spatial pivotal linking between said barrel and said base platform;

(b) means for tipping the barrel in a vertical plane which comprises:

(1) a tripod with parallel legs that are pivotally attached to said base platform, and fitted with a raising mechanism;

(2) a lower stop, located upon one of the tripod legs, to act as a minimum elevation angle limiter to operate in conjunction with:

(3) a main spindle which is driven by the raising mechanism and makes the barrel tip, where said spindle is connected to said barrel through a cross control mechanism which travels in relation thereto thanks to a guide collar;

(4) a set of rear legs which are parallel and likewise pivotally attached to said base platform, and mounted upon the spindle, each with a set of pressure rings;

(c) a mechanism for sweep control for crosswise adjustment of the barrel, said sweep control comprising:

(1) a support fork that is pivotally attached to the head of the spindle;

(2) a control spindle that is pivotally attached to the guide collar which travels on the barrel;

(3) a cross spindle mounted upon the arms of said support fork and possessing its own drive arrangement which, upon rotating, moves the control fork in a crosswise direction, and with it, the collar and barrel;

(4) a levelling mechanism, the levelling mechanism comprised of:

(i) a sleeve which is pivotally attached to the support fork and in whose interior there slides:

(ii) a spindle, whose head is pivotally attached to the main spindle at a point above that of the pivotal attachment between the support fork and the spindle head.

8. A mortar, comprised of a barrel mounted upon a base platform and further comprising:

(a) means of spatial pivotal linking between said barrel and said base platform;

(b) means for tipping the barrel in a vertical plane which comprises:

(1) a tripod with parallel legs that are pivotally attached to said base platform, and fitted with a raising mechanism;

(2) a lower stop, located upon one of the tripod legs, to act as a minimum elevation angle limiter to operate in conjunction with:

(3) a main spindle which is driven by the raising mechanism and makes the barrel tip, where said spindle is connected to said barrel through a cross control mechanism which travels in relation thereto thanks to a guide collar;

(4) a set of rear legs which are parallel and likewise pivotally attached to said base platform, and mounted upon the spindle, each with a set of pressure rings;

(c) a mechanism for sweep control for crosswise adjustment of the barrel;

(d) the mortar laying mechanisms are provided with a control handwheel which is comprised of:

(1) a rim with a hollow inside and two diametrically opposed openings;

(2) a handle whose length is approximately equal to the diameter of the rim and which turns inside the first of the said opening in such rim;

(3) means for holding the handle in its working position and in its idle position.

9. A mortar in full accordance with claim 8 above and characterized inasmuch that said means for holding the handle are comprised of:

(a) a pliable metal strip attached by one of its ends to the bottom of the hollow in the rim while its other extends through the inside of the first opening in the rim, and possessing a protrusion that engages in:

(b) either one of two slots in the handle rotating shaft.

10. A mortar in full accordance with claim 8 and characterized because the outside surface of the rim is rough.

11. A mortar in full accordance with claim 8 and characterized because when the handle is in the idle position, its head is concealed inside the second open on the rim.

* * * * *